United States Patent [19]

Berman et al.

[11] 3,972,298

[45] Aug. 3, 1976

[54] PRETENSION THREADING DEVICE

[75] Inventors: Gustave Berman, Rockaway; Robert Barrett Brauch, Wayne, both of N.J.

[73] Assignee: The Singer Company Patent Department, New York, N.Y.

[22] Filed: June 10, 1975

[21] Appl. No.: 585,557

[52] U.S. Cl. ..... 112/254; 112/259

[51] Int. Cl.[2] ..... D05B 47/00

[58] Field of Search ..... 112/254, 259

[56] References Cited

UNITED STATES PATENTS

| | | | |
|---|---|---|---|
| 257,052 | 4/1882 | Neilly | 112/254 |
| 995,312 | 6/1911 | Woodhead | 112/254 |
| 1,020,090 | 3/1912 | Gray | 112/254 |
| 2,997,010 | 8/1961 | Hughes | 112/254 |

*Primary Examiner*—Werner H. Schroeder
*Assistant Examiner*—Conrad L. Berman
*Attorney, Agent, or Firm*—Edward L. Bell; Robert E. Smith; Edward P. Schmidt

[57] ABSTRACT

Pretension threading device which includes two thread deflecting means supported on opposite sides of a pretension, and arranged to deflect thread caught and drawn into the thread deflecting means into wrap around the pretension. One thread deflecting means extends to beyond the pretension in a direction away from a thread supply tapering to a point beyond the pretension spaced from the adjacent sewing machine housing. The other thread deflecting means lies in covering relationship to the pretension, terminating at the pretension and tapering beyond the pretension device in a direction away from the thread supply to the adjacent sewing machine housing.

4 Claims, 3 Drawing Figures

PRETENSION THREADING DEVICE

BACKGROUND OF THE INVENTION

The invention is concerned with a means of easily threading a pretension located on a surface of a sewing machine not readily observable by a sewing machine operator, or of threading a pretension wherever located with a bare minimum of operator attention and care.

Prior art pretension or tension devices generally require some care in order to assure proper engagement of sewing thread with the tensioning means. Because the usual sewing machine requires the sewing thread to engage with many components thereof in order to be operable, simplification of threading is a sought after objective. Thus many varieties of self-threading sewing machine take-ups are provided, as well as thread guides, such as pigtails, which do not require threading of an eyelet, but permit the sewing thread to be drawn into an eyelet via, for example, a slot of some form.

What is required is an economical and easy means for threading a pretension which will be effective even when not visible to the sewing machine operator.

SUMMARY OF THE INVENTION

The above desired objective has been achieved in a thread guiding means to a pretension located on the rear surface of a sewing machine, spaced from a thread supply similarly located. A support bracket, affixed to the sewing machine frame, extends from the rear surface of the sewing machine to support the pretension. An ear of the support bracket extends in a direction away from the thread supply and tapers to a point spaced from the rear surface of the sewing machine. Thus is formed a thread catching means for thread drawn from the thread supply over the rear surface of the sewing machine. A fin extension protruding from the rear of the sewing machine overlies the pretension in covering relationship, and tapers to the rear surface in a direction away from the thread supply. Thus thread drawn from the thread supply and taken by the thread catching means is deflected by the fin extension and the ear of the support bracket about the pretension without further operation attention or care.

BRIEF DESCRIPTION OF THE DRAWINGS

The invention may be further understood by reference to the specification and the drawings in which:

Referring to FIG. 1 there is shown an end elevation of a sewing machine 10 including a bed 11 supporting a standard 12 and upwardly open bracket arm 13. The bracket arm 13 terminates in a head 14 in which is supported a needle bar 16, carrying a needle 17, and presser bar 18, which may be elevated by manipulation of presser bar lifting lever 19. Knob 20 may be adjusted to control the pressure applied to work material by presser foot 21 carried by the presser bar 18.

Figure 1:
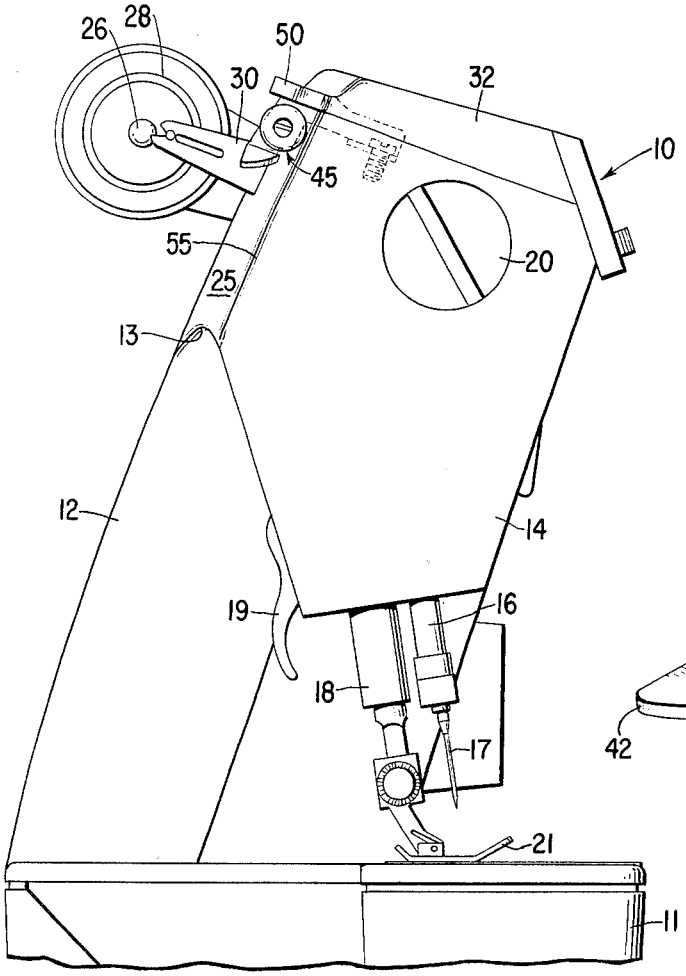
FIG. 1 is an end elevation of a sewing machine showing the location of the rear mounted spool pin, pretension and thread guiding means of the invention.
Figure 3:
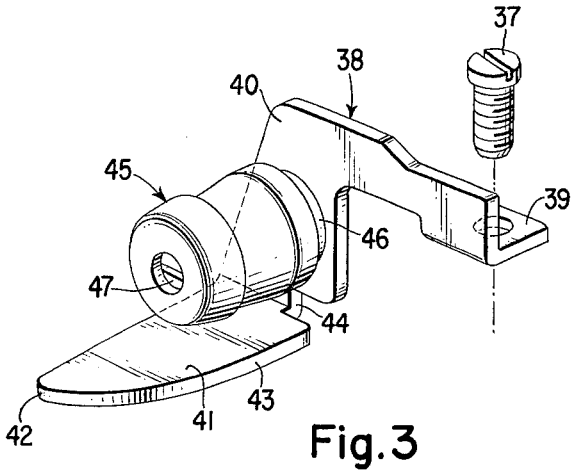

On the rear surfaces 25 of the sewing machine 10 there is supported a spool pin 26 carrying a thread spool 27 and a thread spool retainer and thread lead off 28. Spaced from the thread spool 27 on the rear surface is a thread guide 30.

Figure 2:
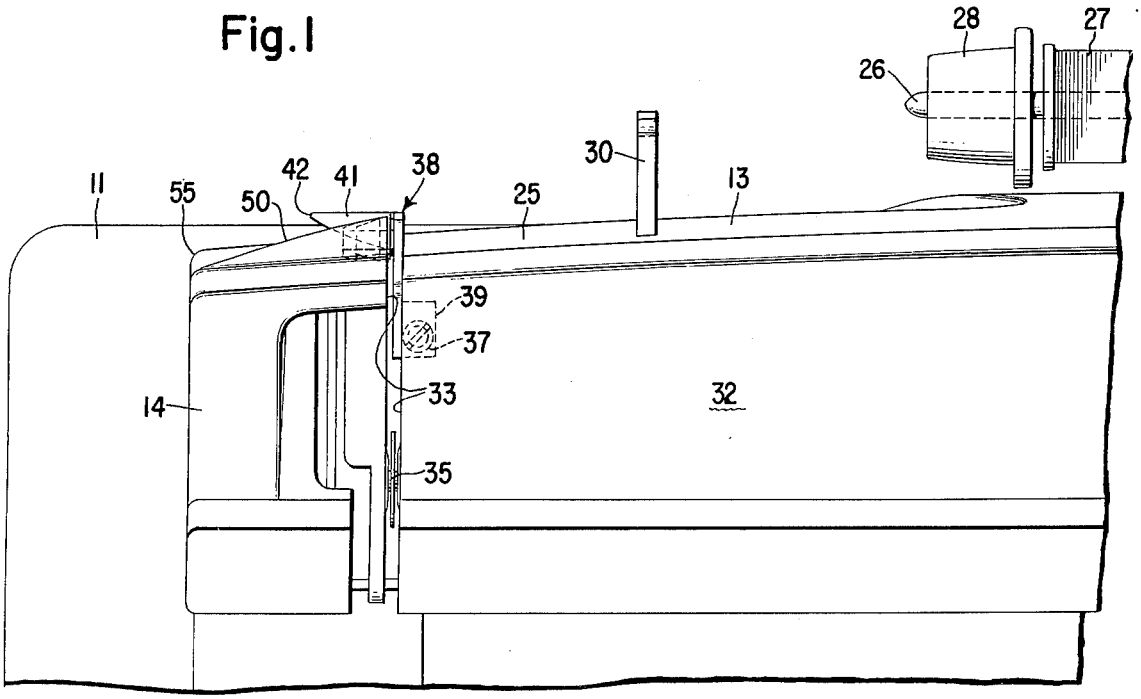
FIG. 2 is a view of a part of the sewing machine in plan more clearly illustrating the relationship of the thread guiding means and the pretension; and, FIG. 3 is a perspective view of the support bracket and pretension indicating details of the thread catching and lower thread deflecting ear of the support bracket.

The standard 12, bracket arm 13 and head 14 are covered by a top cover 32, which is fashioned with a slot 33 (See FIG. 2) within which are located tension discs 35 of the main tension device for the sewing machine 10.

Also located within the slot 33 in the top cover 32 and affixed to the bracket arm 13 by screw 37 is a support bracket 38. The screw 37 affixes the support bracket 38 to the bracket arm 13 by means of lug 39 which is situated at right angles to vertical plane surface 40 extending along slot 33 to the exterior of the sewing machine adjacent the rear surface 25. A pretension 45 is attached to the vertical plane surface 40, ideally to form therewith a thread engaging means, the thread being pressed between convex spring loaded disc 46 of the pretension and the vertical plane surface 40. Screw 47 is utilized to fix an adjusted tension for the pretension 45.

The vertical plane surface 40 of the support bracket 38 is further formed with ear 41 which extends beneath the pretension device 45 external of the rear surface 25 of the sewing machine 10. The ear 41 extends in a direction away from the thread spool 27, and tapers to a point 42 spaced from the rear surface which, as explained below, forms a thread catching point for thread extending from the thread spool 27. Ideally the ear 41 tapers to point 42 by means of a convex edge 43 which terminates in a thread guiding notch 44 located in alignment with the thread engaging means of the pretension 45, in this case, at the vertical plane surface 40.

The top cover 32 is formed with a fin extension 50, operating as a thread deflecting means, which extends in covering relationship closely adjacent the pretension 45, terminating at the slot 33 in the top cover 32, and tapering to the rear surface 25 of the sewing machine 10 in a direction away from the thread spool 27. As is apparent in FIG. 2, the fin extension 50 completely overlies the pretension device 45, which itself may be conically formed to decrease the amount of extension required. As is also apparent in FIG. 2, the point 42 of the ear 41 on support bracket 38 is spaced from the rear surface 25 of the sewing machine 10 and from the fin extension 50. Thus, thread from thread spool 27 engaged by thread guide 30 may be drawn around corner 55 of the sewing machine below the ear 41, and then drawn upward to be caught on the convex edge 43 of ear 41 inside point 42, to be deflected towards the rear surface 25 of the sewing machine 10 to the thread holding notch 44, while also being deflected by fin extension 50 of the top cover 32, thereby guiding the thread about the pretension device 45 to a position between the disc 46 and the plane surface 40 of the support bracket 38 and in the slot 33 of the top cover.

The pretension device 45 illustrated is a horizontal axis device. It will be apparent that the teachings of the invention are not limited to a horizontal axis pretension, but may also be applied to a vertical axis pretension supported, for example on the ear 41 of the support bracket 38. In this event the thread holding notch 44 would be located on the convex edge 43 on the side of the pretension device 45 away from the thread spool, and the fin extension 50 would closely overlie the pretension device as previously described. Ideally, a vertical pretension device would be conically shaped to direct thread downwardly to between the convex spring loaded disc 46 and the ear 41.

The essence of the invention is to provide a thread catching means associated with a thread deflecting means on one side of a pretension device, which operating in conjunction with a second thread deflecting means on the other side of the pretension device will guide thread about and into the pretension device with minimum of operator attention or care.

Having thus set forth the nature of the invention what we seek to claim is:

1. A device facilitating threading of a pretension means of a sewing machine having a housing and a thread supply means supported for supplying thread to said pretension means, said device comprising:

Support means disposed on said housing for supporting said pretension means externally of said housing and forming with said pretension means a thread tensioning means at said pretension means and said support means interface, said support means including an ear on one side of said pretension means extending in a direction away from the supply of thread from said thread supply means and tapering from a position in overlap with said pretension means and adjacent said housing to a thread catching point at the extremity thereof; and, thread deflecting means disposed closely adjacent to and in spaced relationship to said pretension means said thread deflecting means terminating at said interface, said thread deflecting means tapering to said housing in a direction away from said thread supply means and being positioned for deflecting with said ear of said support means a thread from said thread supply means onto said pretension means;

whereby thread from said thread supply means placed in said thread catching point will be deflected towards said housing by said ear of said support means while simultaneously being deflected about said pretension means to said interface by said thread deflecting means.

2. A device facilitating threading of a pretension means of a sewing machine having a housing and a thread supply means supported for supplying thread to said pretension means, said device comprising:

support means disposed on said housing for supporting said pretension means externally of said housing and forming with said pretension means a thread tensioning means at said pretension means and said support means interface, and support means including an ear on one side of said pretension means extending in a direction away from the supply of thread from said thread supply means and having an edge tapering from a position in overlap with said pretension means and adjacent said housing to a thread catching point at the extremity thereof, said ear having a thread guiding notch on said tapering edge adjacent said interface; and, thread deflecting means disposed closely adjacent to and in spaced relationship to said pretension means, said thread deflecting means terminating at said interface said thread deflecting means tapering to said housing in a direction away from said thread supply means and being positioned for deflecting with said ear of said support means a thread from said thread supply means onto said pretension means;

whereby thread from said thread supply means, placed in said thread catching point will be deflected towards said housing by said ear of said support means into said thread guiding notch, while simultaneously being deflected about said pretension means by said thread deflecting means.

3. A device facilitating threading of a pretension means of a sewing machine having a housing and a thread supply means supported for supplying thread to said pretension means, said pretension means including thread motion restraining surfaces therein, said device comprising:

support means disposed on said housing for supporting said pretension means externally of said housing, said support means including an ear on one side of said pretension means extending in a direction away from the supply of thread from said thread supply means and having an edge tapering from a position in overlap with said pretension means and adjacent said housing to a thread catching point at the extremity thereof, said edge having a thread guiding notch adjacent said pretension means aligned with said thread motion restraining surfaces; and, thread deflecting means disposed closely adjacent to and in spaced relationship to said pretension means terminating at said thread motion restraining surfaces of said pretension, said thread deflecting means tapering to said housing in a direction away from said thread supply means and being positioned for deflecting a thread from said thread supply means onto said thread motion restraining surfaces of said pretension means;

whereby said thread from said thread supply means placed in said thread catching point will be deflected towards said housing by said ear of said support means, into said thread guiding notch, while simultaneously being deflected about said pretension means to said thread motion restraining surfaces by said thread deflecting means.

4. In a sewing machine including a vertical standard supporting a horizontal bracket arm having an upper surface, a front surface facing a sewing machine operator, and a rear surface having means supporting a thread spool, an upwardly open slot in said upper surface extending substantially from said rear surface to said front surface, an upper thread tension device having tensioning discs within said upwardly open slot, a support bracket secured to said bracket arm and extending from said rear surface, a pretension means supported on said support bracket in substantial alignment with said slot, said support bracket having an ear extending beneath said pretension means in a direction away from said thread spool and tapering away from said rear surface to a thread catching point at the extremity thereof, said upper surface being formed with a thread deflecting means disposed closely adjacent to and in spaced relationship to said pretension means and terminating at said slot, said thread deflecting means tapering beyond said pretension means to said rear surface in a direction away from said thread spool and being positioned for deflecting with said ear of said support bracket a thread from said thread spool onto said pretension means.

* * * * *